US007255238B2

(12) United States Patent
Ikeya

(10) Patent No.: US 7,255,238 B2
(45) Date of Patent: Aug. 14, 2007

(54) TRANSPORTING APPARATUS HAVING VERTICALLY MOVABLE HOLDING PORTION

(75) Inventor: Masayuki Ikeya, Shiga-ken (JP)

(73) Assignee: Daifuku Co., Ltd., Osaka (JP)

( * ) Notice: Subject to any disclaimer, the term of this patent is extended or adjusted under 35 U.S.C. 154(b) by 101 days.

(21) Appl. No.: 10/890,713

(22) Filed: Jul. 14, 2004

(65) Prior Publication Data

US 2005/0011851 A1 Jan. 20, 2005

(30) Foreign Application Priority Data

Jul. 18, 2003 (JP) ..... 2003-276751

(51) Int. Cl.
*B66C 17/12* (2006.01)

(52) U.S. Cl. ..... 212/331; 212/332; 294/907

(58) Field of Classification Search ..... 294/907; 901/46, 47; 212/281, 331
See application file for complete search history.

(56) References Cited

U.S. PATENT DOCUMENTS 4,427,623 A * 1/1984 Howard et al. ..... 376/263
4,428,708 A * 1/1984 Burt ..... 414/275
5,048,703 A * 9/1991 Tax et al. ..... 212/276
5,100,286 A * 3/1992 Anderson ..... 414/749.4
5,649,636 A * 7/1997 Baumann ..... 212/344
6,086,321 A * 7/2000 Takahashi et al. ..... 414/793
6,315,513 B1 * 11/2001 Harukawa et al. ..... 414/286
6,880,712 B2 * 4/2005 Uchida et al. ..... 212/276
6,968,963 B1 * 11/2005 Zakula et al. ..... 212/270

FOREIGN PATENT DOCUMENTS

JP 1994-HO6-135685 A 5/1994
JP 2003-34490 A * 2/2003
JP 2003-128381 A 5/2003

* cited by examiner

*Primary Examiner*—Thomas J. Brahan
(74) *Attorney, Agent, or Firm*—The Webb Law Firm

(57) ABSTRACT

The present invention provides a transporting apparatus provided with a sensor for detecting information relating to a relative position in the vertical direction between an article to be transported and a holding portion for holding the article, and a controller that is linked to this sensor through signals, wherein the controller raises the holding portion by a set raising amount when the sensor detects that the holding portion is below a target lowering position. Thus, it is possible to provide a transporting apparatus with which the position of the holding portion can be automatically moved to a suitable position even if the holding portion is lowered too far with respect to the article.

13 Claims, 11 Drawing Sheets

2
31
a
38
34
21
35
22
39
39a
41(36,37)
42(36,37)
7
3
9
8
41
42

2
31
a
38
34
21
35
22
41
(36,37)
42
39
39a
7
3
9
8

TRANSPORTING APPARATUS HAVING VERTICALLY MOVABLE HOLDING PORTION

BACKGROUND OF THE INVENTION

An example of a conventional transporting apparatus having a vertically movable holding portion is disclosed in JP 2003-128381A (paragraphs [0014] to [0021], FIGS. 2, 4, 5). This transporting apparatus is provided with a traveling carriage for transporting articles, which is provided with a suspension piece for supporting in a suspended state a holding portion for holding an article, in such a manner that the suspension piece can be freely raised and lowered by a raising and lowering motor, and is provided with control means for controlling actuation of the raising and lowering motor and the holding portion switching operation of switching the holding portion between a holding state and a hold release state such that, with that traveling carriage stopped at a target position for article transfer, the holding portion is raised and lowered and a retrieval operation of retrieving an article loaded on an article station and a release operation of releasing an article on the article station are performed.

That is, the transporting truck is provided with a holding portion supported suspended by a wire, and with the transporting truck stopped at a position above a container retrieval position, the holding portion is raised and lowered by raising and lowering the wire with a drum drive motor, and the holding portion is switched between a state in which a pair of holding pieces are swung toward one another to hold the flange of a transporting container and a state in which the pair of holding pieces are swung away from one another to release their hold on the flange of the transporting container, thereby using the holding portion to retrieve the transporting container from the container retrieval station and release the transporting container at the container retrieval station.

This type of transporting apparatus is provided with a raised/lowered amount detection sensor for detecting the amount that the holding portion has been raised or lowered by the raising and lowering motor, and is configured such that when performing the retrieval operation or the release operation with the holding portion, control is executed to operate the raising and lowering motor based on the information detected by the raised/lowered amount detection sensor, and thus the holding portion is lowered to a target lowering position for switching to the holding state or the hold release state.

In such transporting apparatuses, when for example an abnormality occurs in the setting state of the article loading stand, which forms the article station, and causes a change in the distance from the article station to the path over which the traveling carriage is moved or the suspension piece is extended, then even if based on detection information from the raised/lowered amount detection sensor for detecting the amount that the holding portion is raised or lowered by the raising and lowering motor it is determined that the holding portion is in the target lowering position, in practice there are cases where the holding portion has been lowered too far below the target lowering position. When the holding portion has been lowered too far below the target lowering position, then, for example, the holding chucks of the holding potion come into contact with a portion of the article, making it difficult or impossible for the holding portion to be switched to the holding state or the hold release state.

For this reason, conventionally a configuration has been adopted in which an excess lowering detection sensor is provided for detecting the relative positional relationship in the vertical direction between a holding portion that has been lowered to a target lowering position and an article loaded on the article station to detect whether the holding portion has been lowered too far below the target lowering position, and operation of the transporting apparatus is stopped when this excess lowering detection sensor detects that the holding portion has been lowered too far.

SUMMARY OF THE INVENTION

With the conventional transporting apparatus described above, each time it is detected that the holding portion has been lowered too far, it is necessary to perform a task to correct this excess lowering, such as physically adjusting the setting state of the article station or winding in the suspension pieces, to restart operation of the transporting apparatus, and thus there was room for improving the transporting efficiency.

It is an object of the invention to provide a transporting apparatus with which it is possible to continue operation of the transporting apparatus even when the holding portion has been lowered too far, without always requiring work to remedy this situation.

A transporting apparatus according to the present invention is provided with a sensor for detecting information relating to a relative position in the vertical direction between the holding portion and the article, and a controller that is linked by signals to this sensor, wherein the controller raises the holding portion by a set raising amount when the sensor detects that the holding portion is below a target lowering position. It is thus possible to achieve the foregoing object.

DETAILED DESCRIPTION OF PREFERRED EMBODIMENTS

Preferred embodiments of the present invention are described below with reference to the drawings.

Figure 1:
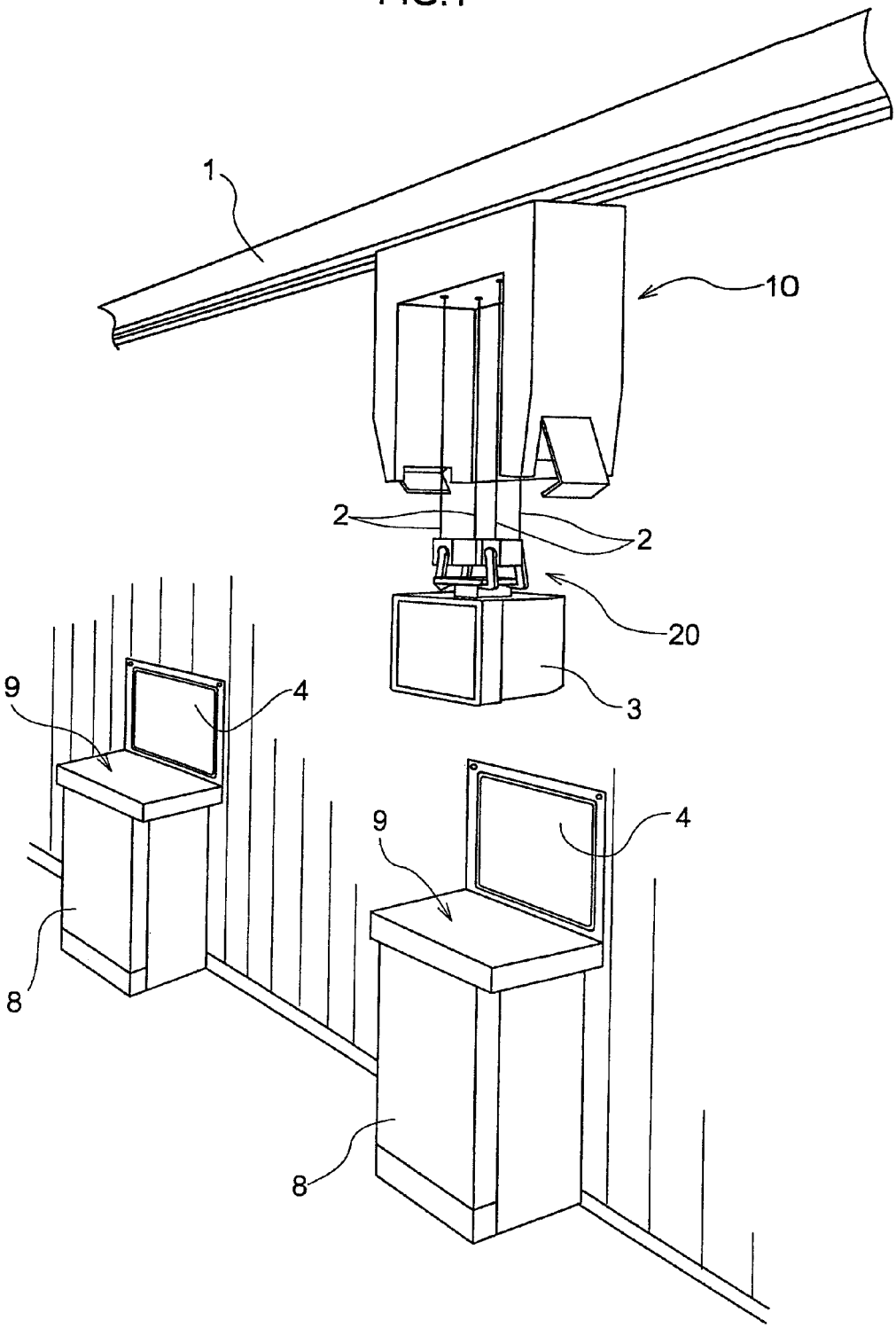
FIG. 1 is a perspective view of a transporting apparatus according to the present invention.
Figure 2:
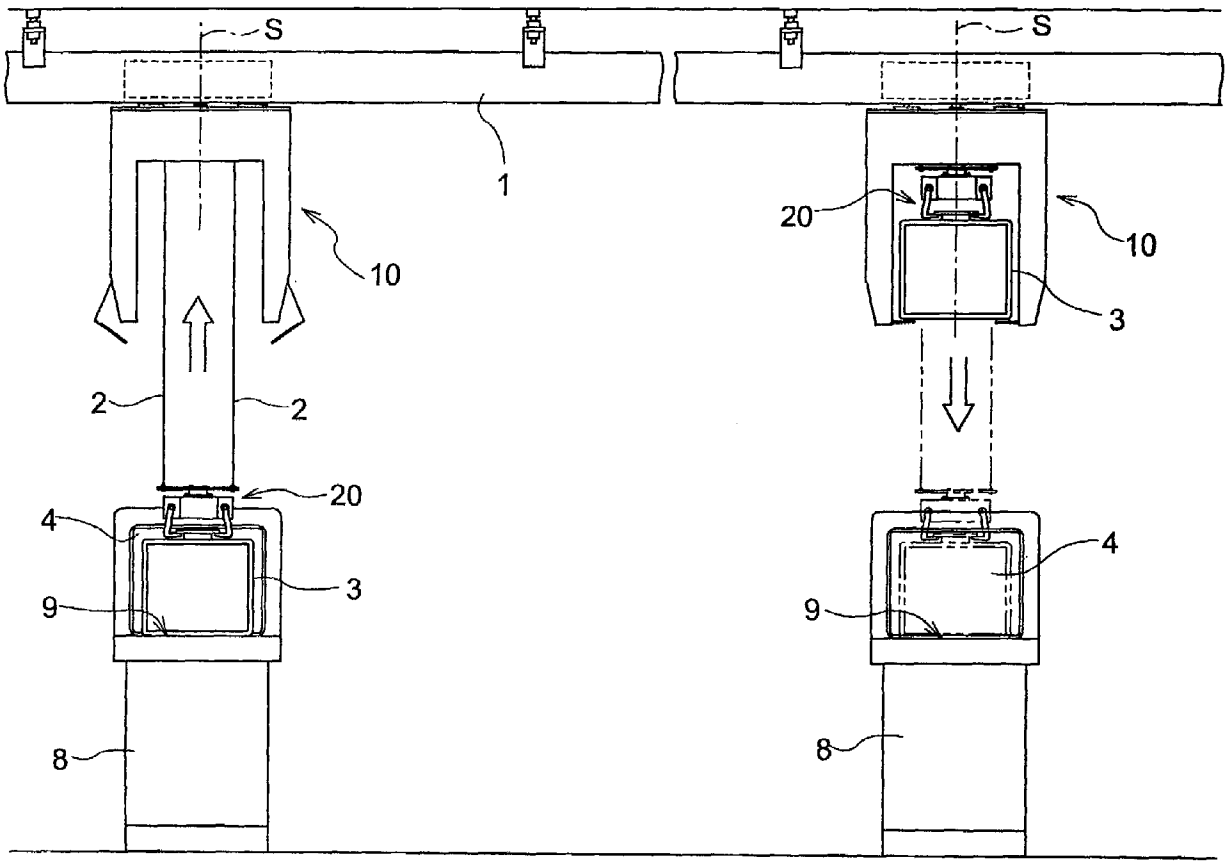
FIG. 2 is a front view of the transporting apparatus according to the present invention.

As shown in FIG. 1, a transporting apparatus having a vertically movable holding portion is provided with a traveling carriage 10 that travels along a guide rail 1, and a holding portion 20 supported on the traveling carriage 10, via a plurality of suspension wires 2, suspended in such a manner that it can be raised and lowered.

This transporting apparatus, in an installation where semiconductor substrates are manufactured, is automatically operated in accordance with an operation command and carries a container 3, as an example of article to be transported, accommodating semiconductor substrates to outside an article transfer window 4 of a manufacturing room for each manufacturing process. More specifically, it has the following configuration.

Figure 4:
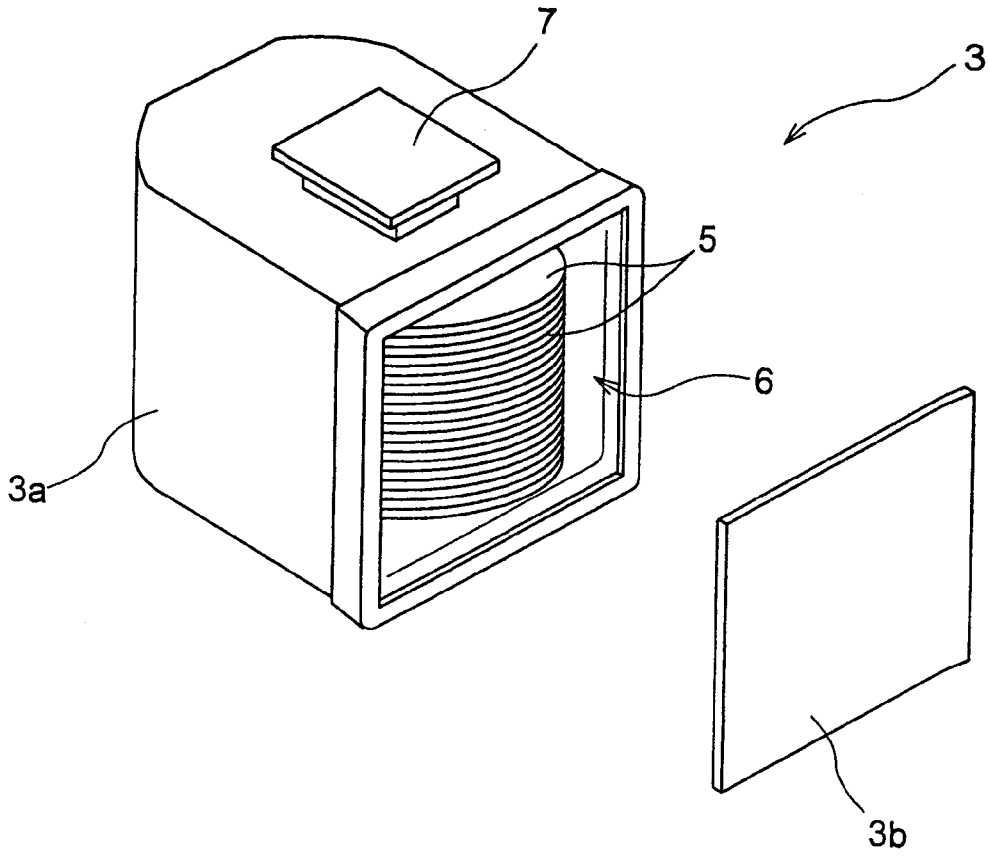
FIG. 4 is a perspective view of the container.

As shown in FIG. 4, the container 3 is made of a main container unit 3*a* provided with an access opening 6 through which a plurality of semiconductor substrates 5 are stored and retrieved, and a detachable lid member 3*b* that hermetically seals the access opening 6 during transporting. A flange 7 rectangular in plan view that allows holding by the holding portion 20 is provided on the upper surface of main container unit 3*a*.

As shown in FIG. 1, an article station 9 is formed by the loading surface of an article loading stand 8 outside the article transfer window 4 of each manufacturing room. The container 3 is placed on the article station 9 with the flange 7 positioned above the container 3.

Figure 3:
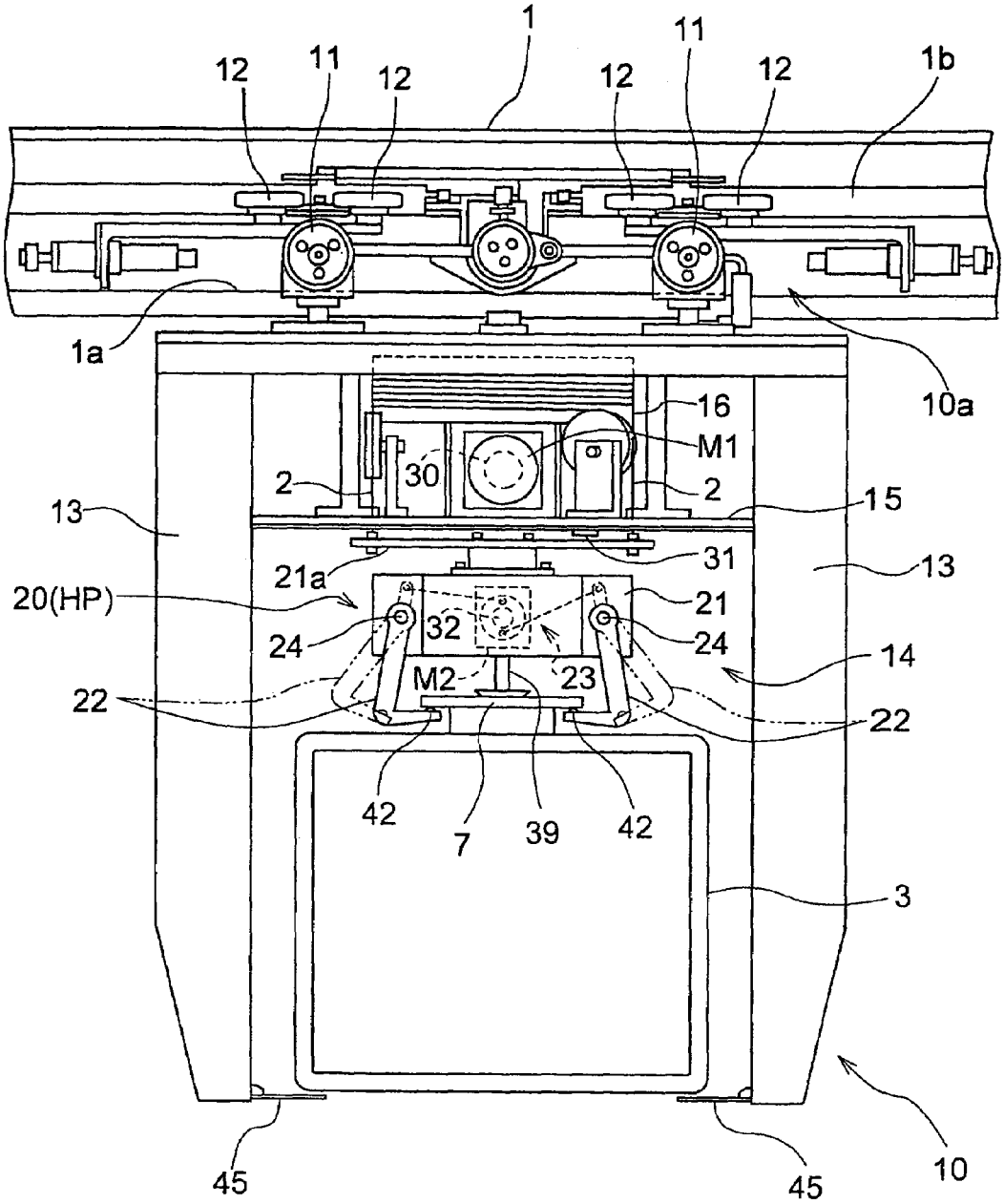
FIG. 3 is a front view of the traveling carriage and the holding portion according to the present invention.

As shown in FIG. 3, the traveling carriage 10 is provided with, for example, travel wheels 11 riding on a travel surface 1*a* of the guide rail 1, anchor wheels 12 that abut against an anchor guide surface 1*b* of the guide rail 1, and a linear motor (not shown) provided between a truck body 10*a*, which has the anchor wheels 12 and the travel wheels 11, and the guide rail 1. The traveling carriage 10 moves above the article stations 9 along the guide rail 1 due to the drive force of the linear motor.

As shown in FIG. 3, for example, below the truck body 10*a* provided with the travel wheels 11 and the anchor wheels 12 is provided an article accommodation space 14 formed by a pair of accommodation frames 13 lined up in the movement direction of the traveling carriage 10, a revolving drum 16 and an electric raising and lowering motor M1 provided on a support frame 15 located in an upper portion of the article accommodation space 14, and the plurality of suspension wires 2 that are wound out from the revolving drum 16.

The end portion of each of the plurality of the suspension wires 2 is linked to a wire linkage portion 21*a* positioned at the upper end of a holding portion frame body 21 of the holding portion 20. The revolving drum 16 is rotatively driven in the forward rotation direction and the reverse rotation direction about an axis in the traveling carriage vertical direction by the raising and lowering motor M1. That is, when the drum 16 is rotatively driven in one of the forward or reverse rotation directions, the plurality of suspension wires 2 are wound out, and when it is rotatively driven in the other rotation direction, the wires 2 are wound in. In this manner, the traveling carriage 10 supports the holding portion 20 in a suspending manner through the plurality of suspension wires 2, and by rotating the revolving drum 16 with the raising and lowering motor M1, the following operations are possible:

(1) Retrieving the container 3 loaded on an article station 9 with the holding portion 20 by winding out the suspension wires 2;

(2) Lowering the holding portion 20 from the article accommodation space 14 toward the article station 9 in order to release the container 3 on the article station 9 with the holding portion 20;

(3) Storing the container 3 retrieved from the article station 9 in the article accommodation space 14 by rotating the revolving drum 16 with the raising and lowering motor M1 to wind up the suspension wires 2; and (4) Lifting up the holding portion 20 in order to return to the article accommodation space 14 (home position HP) the empty holding portion 20 after it has released the container 3.

As shown in FIG. 3, the holding portion 20 is provided with the holding portion frame body 21, a pair of holding chucks 22 provided outside a lower portion of the holding portion frame body 21, and an electric holding motor M2 provided inside the holding portion frame body 21. The output portion of the holding motor M2 is linked to the pair of holding chucks 22 by a linking mechanism 23 that includes links. By rotatively driving the holding motor M2 in the forward rotation direction or the reverse rotation direction, the pair of holding chucks 22 are shiftably actuated about a linking shaft 24 at their base end side to manipulate the holding chucks 22 between a closed position where their hook tip sides are toward one another and an open position where their hook tips are away from one another.

Thus, as shown by the solid lines in FIG. 3, the pair of holding chucks 22 are switched to the closed position by the holding motor M2 such that their hook tip sides enter below the lower surface side of the flange 7 of the container 3, shifting the holding portion 20 to a position where the pair of holding chucks 22 hold the container 3. Furthermore, as shown by the long-short dashed lines in FIG. 3, by changing the position of the pair of holding chucks 22 to the open position with the holding motor M2, the hook tip sides of the holding chucks 22 are moved outward away from the flange 7, putting the holding portion 20 into the hold release state in which holding of the container 3 by the pair of holding chucks 22 is released.

Figure 5:
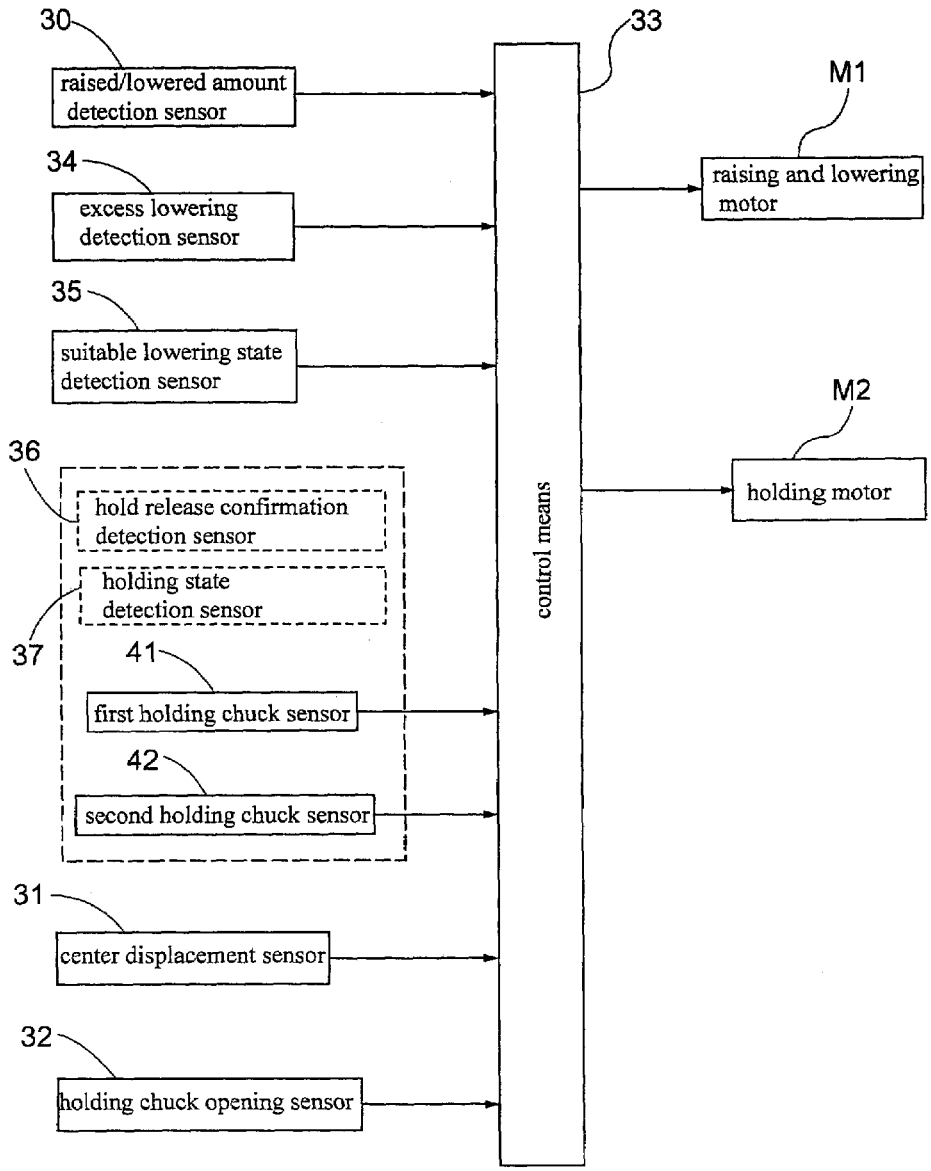
FIG. 5 is a block view showing the control system.

As shown in FIG. 3, the traveling carriage 10 is provided with a raised/lowered amount detection sensor 30 at the section where the raising and lowering motor M1 is located. A center displacement sensor 31 is provided on the support frame 15 of the traveling carriage 15. A holding chuck opening sensor 32 is provided on the holding portion frame body 21 of the holding portion 20. As shown in FIG. 5, control means 33 linked to the sensors 30 to 32 is linked to the raising and lowering motor M1 and the holding motor M2. The control means 33 is also linked to an excess lowering detection sensor 34, a suitable lowered state detection sensor 35, a hold release confirmation detection sensor 36, and a holding state detection sensor 37 provided in the holding portion 20 as shown in FIG. 8.

The raised/lowered amount detection sensor 30 is a rotary encoder for sensing rotation of the output portion of the raising and lowering motor M1, and when the raising and lowering motor M1 winds out the suspension wires 2, the raised/lowered amount detection sensor 30 detects the number of revolutions of the motor output portion and converts the result of this detection into an electric signal that it outputs to the control means 33, and thus the amount that the holding portion 20 has been lowered by the raising and lowering motor M1 is detected. Similarly, when the raising and lowering motor M1 winds up the suspension wires 2, the raised/lowered amount detection sensor 30 detects the number of revolutions of the motor output portion and converts the result of this detection into an electric signal that it outputs to the control means 33, and thus the amount that the holding portion 20 has been raised by the raising and lowering motor M1 is detected.

As shown in FIG. 8, the center displacement sensor 31 emits a laser light a toward a detected member 38 provided on the wire linkage portion 21*a* of the holding portion frame body 21, receives the laser light a that is reflected by the reflective surface of the detected member 38 and detects whether there has been a change in the light reception position, and converts the result of this detection into an electric signal that it outputs to the control means 33, and thus whether there has been positional displacement of the holding portion 20 with respect to the article station 9 is detected.

The excess lowering detection sensor 34 has a detector switch provided in the holding portion frame body 21 as shown in FIG. 8, and when the holding portion 20 has been lowered to the target lowering position, the excess lowering detection sensor 34 detects whether it has been lowered too far below the target lowering position and converts the result of this detection into an electric signal that it outputs to the control means 33. The detector switch has a contact portion that comes into contact with a detected member 39 described below, and is configured such that a contact switch within the detector switch is turned on due to this contact. However, it is also possible for the detector switch to be an optical sensor that has a light-emitting portion and a light-receiving portion like that of the center displacement sensor 31. In this case, the detected member 39 is detected when it blocks the light between the light-emitting portion and the light-receiving portion.

Figure 10A:
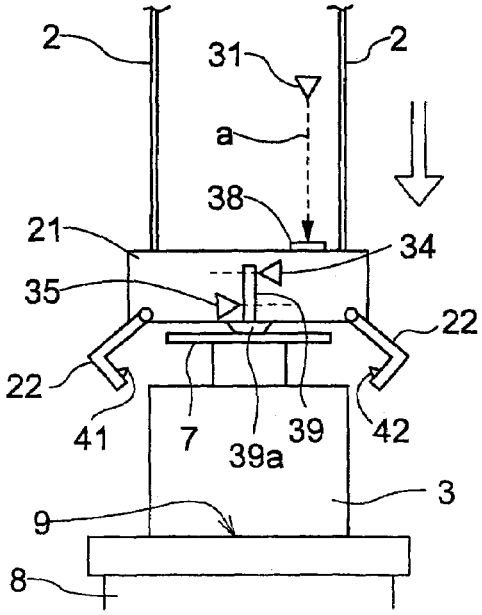
FIGS. 10A and B are explanatory diagrams showing raising correction during the retrieval operation.
Figure 10B:
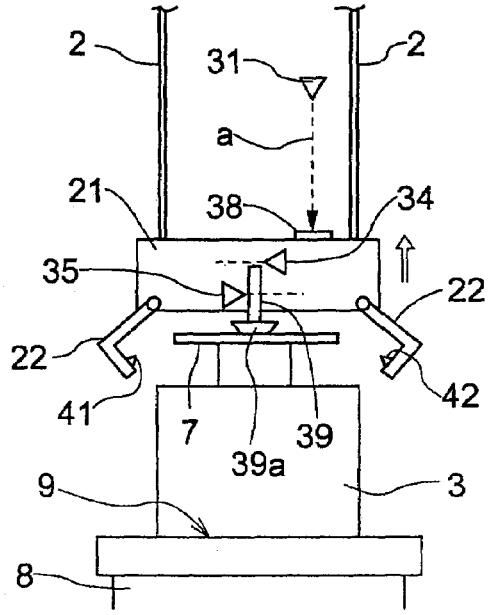

That is, as shown in FIG. 10, the holding portion frame body 21 is provided with a detected member 39 that it can be slid vertically, and together with the holding portion 20 being lowered to the target lowering position, a cone portion 39*a* on the lower end side of the detected member 39 abuts against the upper surface side of the flange 7 of the container 3 loaded on the article station 9. As shown in FIG. 10A, when the holding portion 20 is lowered too far below the target lowering position, the detected member 39 is raised up with respect to the holding portion frame body 21 due to the reaction force from the flange 7, the upper end side of the detected member 39 moves to a position where it is in opposition to the detection portion of the excess lowering detection sensor 34, and the excess lowering detection sensor 34 detects the detected member 39. As shown in FIG. 10B, when the holding portion 20 has not been lowered too far below the target lowering position, then, even if the detected member 39 has been raised up with respect to the holding portion frame body 21 due to the reaction force from the flange 7, the upper end side of the detected member 39 is at a position where it is away from the detection portion of the excess lowering detection sensor 34, and the excess lowering detection sensor 34 does not detect the detected member 39.

That is, the excess lowering detection sensor 34 detects the relative vertical positional relationship between the holding portion 20 lowered to the target lowering position and the container 3 loaded on the article station 9 based on the positional relationship between the excess lowering detection sensor 34 and the detected member 39, and thus detects whether the holding portion 20 has been lowered too far below the target lowering position. Also, by the detected member 39 coming into opposition to the detection portion of the excess lowering detection sensor 34, the excess lowering detection sensor 34 detects that the holding portion 20 has been lowered too far below the target lowering position The suitable lowered state detection sensor 35 has a detector switch provided at a position at a lower level than the excess lowering detection sensor 34 of the holding portion frame body 21 by a set distance as shown in FIG. 8, for example, and detects whether the holding portion 20 that has been lowered to the target lowering position is in a suitable lowered state where it is positioned at or within a suitable range near the target lowering position, and converts the result of this detection into an electric signal that it sends to the control means 33. As the detector switch it is possible to employ the same detector switch as that of the excess lowering detection sensor 34.

Figures 8A, 8B, 8C, 8D:
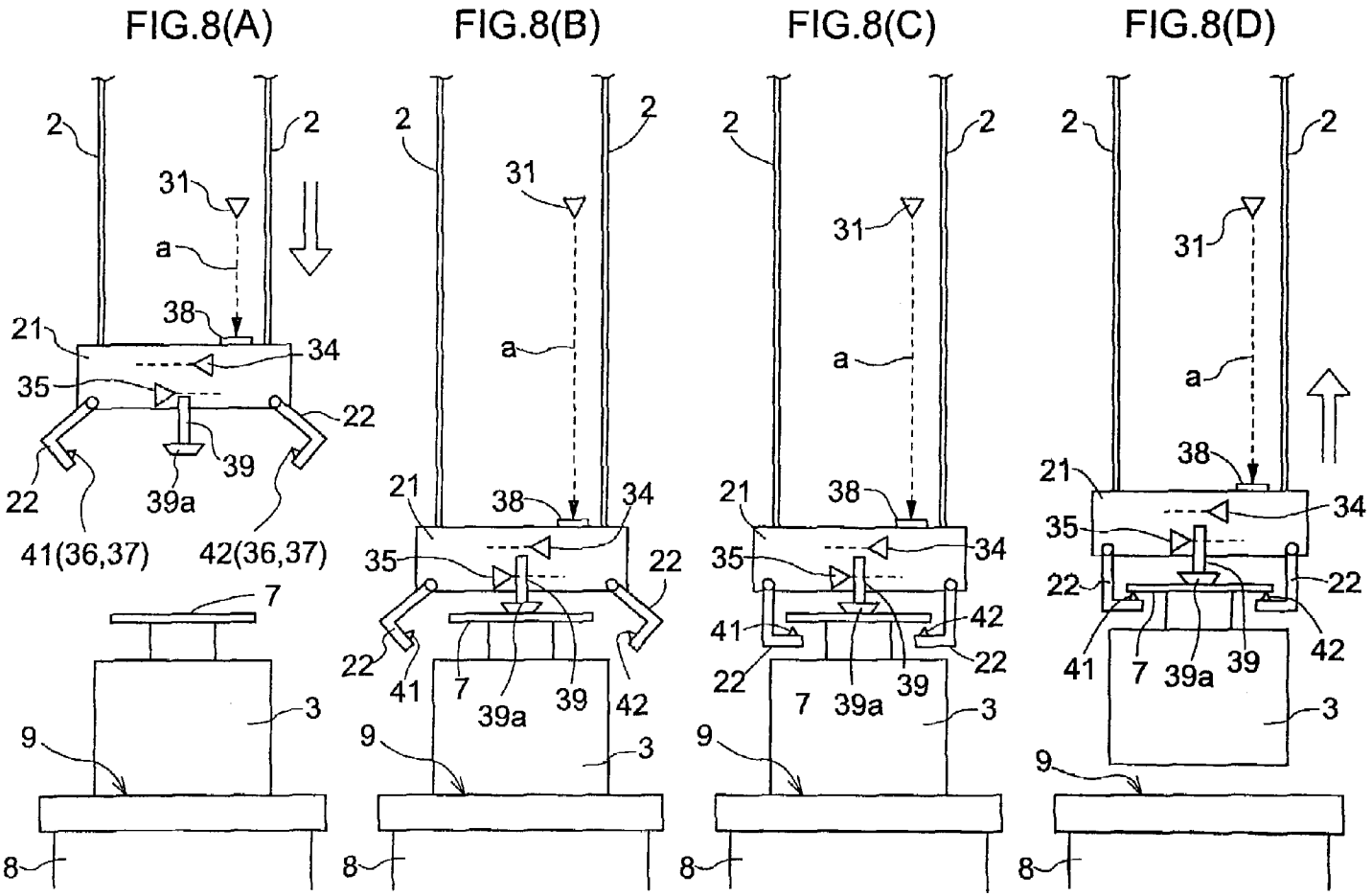
FIGS. 8A, B, C, and D are explanatory diagrams of the retrieval operation.
Figures 9A, 9B, 9C, 9D:
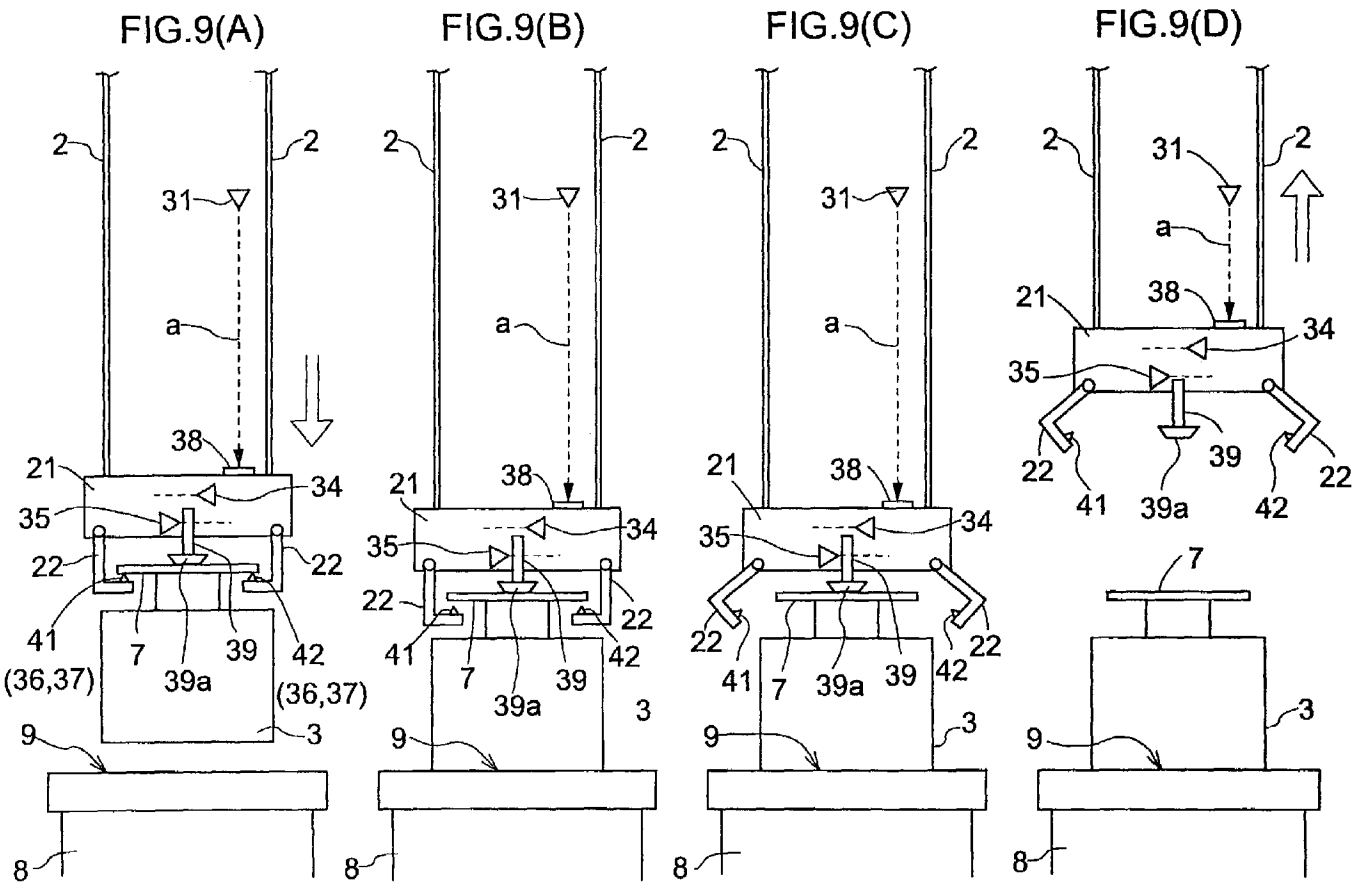
FIGS. 9A, B, C, and D are explanatory diagrams of the release operation.

That is, as shown in FIGS. 8B and 9B, when the holding portion 20 is in the suitable lowered state where it is positioned at or within a suitable range near the target lowering position, the detected member 39 is raised up with respect to the holding portion frame body 21 due to the reaction force from the flange 7, bringing the upper end side of the detected member 39 into opposition with the detection portion of the suitable lowered state detection sensor 35, putting the suitable lowered state detection sensor 35 into the detecting state. When the holding portion 20 is in a state where it is displaced above the suitable lowered state, then the detected member 39 is in a state where its position has been displaced downward from the detection portion of the suitable lowered state detection sensor 35.

In other words, the suitable lowered state detection sensor 35 detects whether the holding portion 20 is in a suitable lowered state by detecting the relative vertical positional relationship between the holding portion 20 lowered to the target lowering position and the container 3 loaded on the article station 9 based on the positional relationship between the suitable lowered state detection sensor 35 and the detected member 39.

The hold release confirmation detection sensor 36 has a first holding chuck sensor 41 provided at the hook tip side of one of the pair of holding chucks 22, and a second holding chuck sensor 42 provided at the hook tip side of the other holding chuck 22, as shown in FIG. 8. The hold release confirmation detection sensor 36 detects, when releasing the container 3 on the article station 9, whether the holding portion 20 that has loaded the container 2 on the article station 9 is in a suitable holding state for hold release that is suitable for switching from the holding state to the hold release state, that is, whether it is in a state where the holding chucks 22 can be smoothly opened such that their hook tip side does not catch on the container 3, and converts the result of this detection into an electric signal that it outputs to the control means 33. The first holding chuck sensor 41 and the second holding chuck sensor 42 are both pressure-sensitive sensors. When both the first holding chuck sensor 41 and the second holding chuck sensor 42 have sensed pressure, it is detected that the holding portion 20 is in a holding state that is suitable for switching to the hold release state. Conversely, when at least one of the first holding chuck sensor 41 and the second holding chuck sensor 42 senses pressure, then it is detected that the holding portion 20 is not in a holding state that is suitable for switching to the hold release state.

The first holding chuck sensor 41 and the second holding chuck sensor 42 both function as holding state detection sensors 37. That is, when the holding portion 20 has been switched to the holding state when retrieving the container 3 from an article station 9, then it is detected whether the holding state in which the holding portion 20 is holding the container 3 loaded on the article station 9 is a suitable holding state in which the container 3 is suitably held, that is, whether it is holding the container 3 in a manner that does not hinder retrieval of the container 3 from the article station 9, and converts the result of this detection into an electric signal that it outputs to the control means 33. That is, when neither the first holding chuck sensor 41 or the second holding chuck sensor 42 sense pressure, then it is detected that the holding portion 20 is in a holding state that is suitable for retrieval of the container 3. Conversely, when at least one of the first holding chuck sensor 41 and the second holding chuck sensor 42 sense pressure, then it is detected that the holding portion 20 is not in a holding state that is suitable for retrieval of the container 3.

The holding chuck opening sensor 32 detects whether the pair of holding chucks 22 are in the holding position or the hold release position based on the position of the linking mechanism 23 linking the holding motor M2 and the pair of holding chucks 22, and converts the result of this detection into an electric signal that it outputs to the control means 33.

The control means 33 has a microcomputer, and when it receives an operate command, it executes control to move the traveling carriage 10 such that the traveling carriage 10 is moved to an article transfer target position S (see FIG. 3) for an article station 9 from which the container 3 is to be retrieved or to which it is to be released. When the traveling carriage 10 arrives at the article transfer target position S, then the control means 33 controls actuation of the raising and lowering motor M1 and the switching operation of the holding portion 20 as shown in FIGS. 6 and 7 so as to raise and lower the holding portion 20 with the traveling carriage 10 stopped at that article transfer target position S, and perform the retrieval operation of retrieving the container 3 that is loaded on the article station 9 or the release operation of releasing the container 3 at the article station 9.

Figure 6:
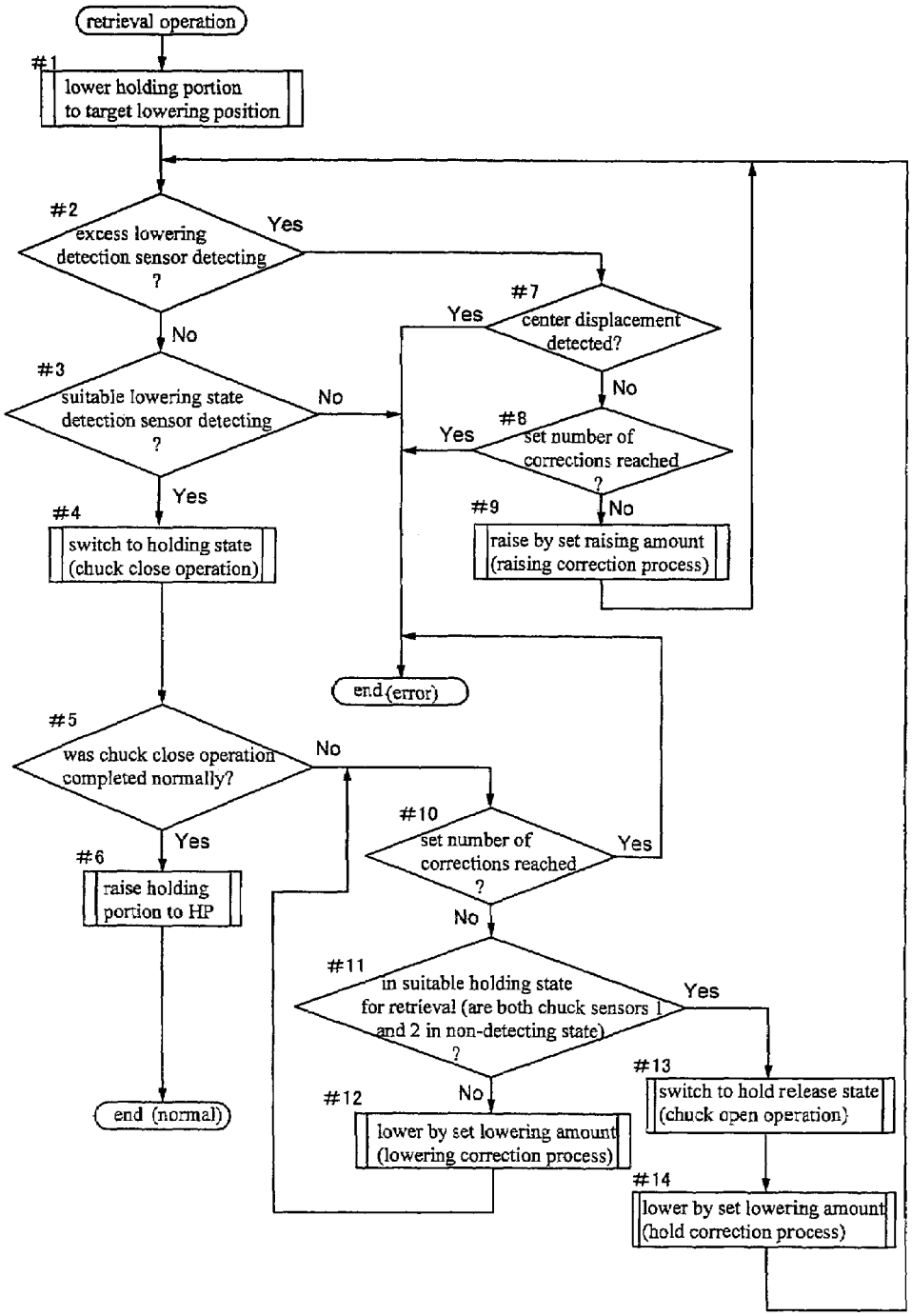
FIG. 6 is a flowchart of the retrieval operation of the transporting apparatus.
Figure 7:
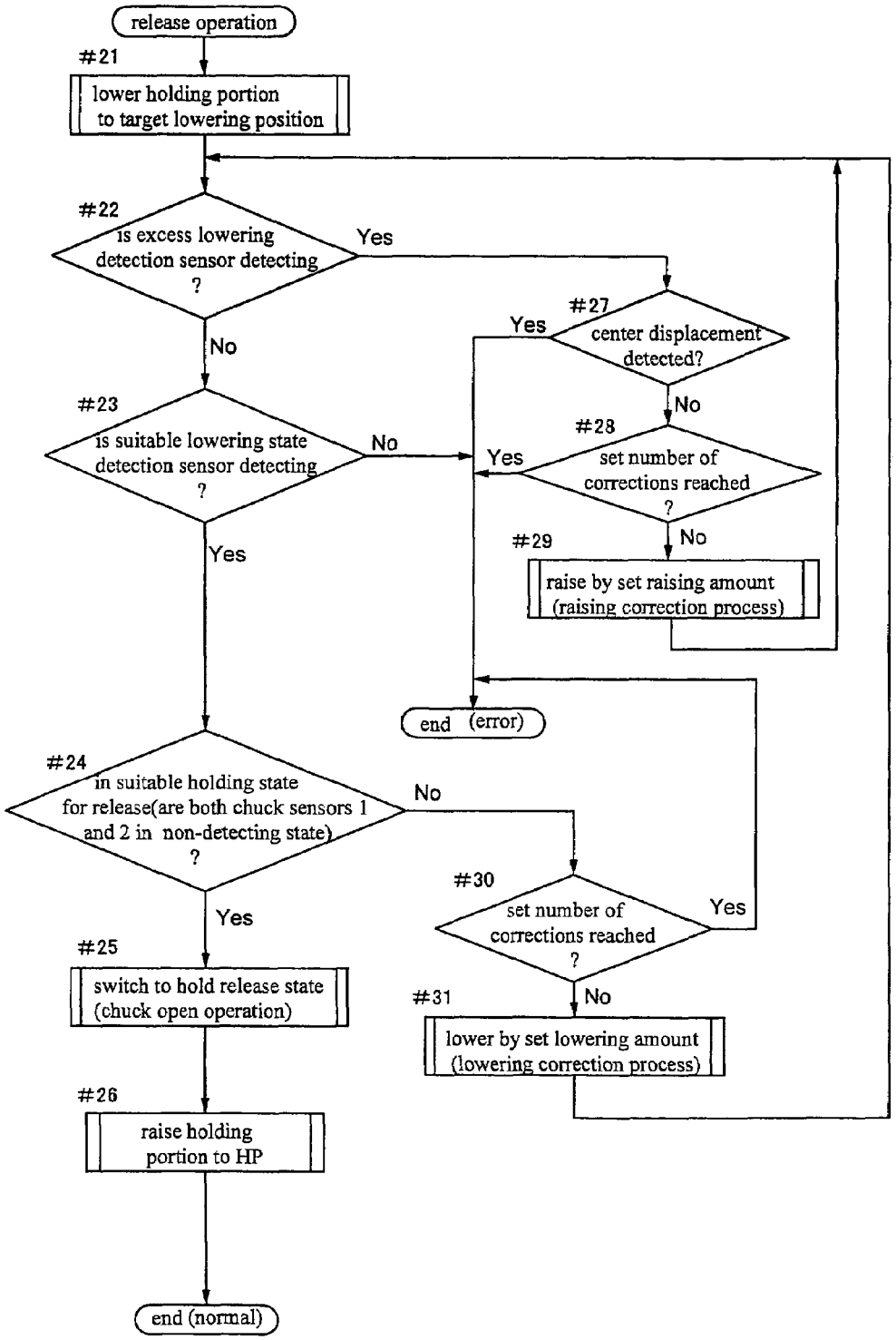
FIG. 7 is a flowchart of the release operation of the transporting apparatus.

That is, as shown in FIG. 6, to execute the retrieval operation, the raising and lowering motor M1 is driven to wind out the wires 2 and lowers the holding portion 20 from the article accommodation space 14 as shown in step 1. Then, when it is detected that the holding portion 20 has been lowered to the target lowering position based on the detection information from the raised/lowered amount detection sensor 30, the raising and lowering motor M1 is stopped to stop lowering of the holding portion 20.

As shown in steps 2, 3, and 4, when lowering of the holding portion 20 has stopped, it is determined whether the excess lowering detection sensor 34 detects excess lowering of the holding portion 20. If it is determined that excess lowering is not detected and that the suitable lowered state detection sensor 35 detects a suitable lowered state, then the holding motor M1 is driven to effect switching of the holding portion 20 to the holding state by closing the holding chucks 22. Next, in steps 5 and 6, it is determined whether the action of closing the holding chucks 22 is complete based on the detection information from the holding chuck opening sensor 32, and if the closing action is complete, then the raising and lowering motor M1 is driven to wind up the wires 2 and raises up the holding portion 20 until it is returned to the home position HP (see FIG. 3) of the article accommodation space 14.

In step 2, if the excess lowering detection sensor 34 detects excess lowering of the holding portion 20, then as shown in step 7, it is determined whether the position of the holding portion 20 has shifted with respect to the article station 9 based on the detection information of the center displacement sensor 31, and if it is determined that position displacement has occurred, then it is determined that an abnormality has occurred and operation is stopped. If it determined that position displacement has not occurred, then in steps 8 and 9 the raising and lowering motor M1 is driven to wind up the wires 2 to execute a raising correction process of raising the holding portion 20 by a set raising amount, and then the procedure is returned to step 2. This set raising amount is preferably set to an amount with which the excess lowering detection sensor 34 will not detect excess lowering, but it can also be set to another amount. While the excess lowering detection sensor 34 detects excess lowering, the above raising correction process is performed repeatedly until a set number of corrections has been performed, and when it is determined that the excess lowering detection sensor 34 continues to detect excess lowering even after the set number of corrections has been performed, then it is determined that an abnormality has occurred and operation is stopped.

In step 3, if is determined that the suitable lowered state detection sensor 35 is not detecting a suitable lowered state, then it is determined that there is an abnormality and operation is stopped.

In step 5, if it is determined that the close operation of the holding portion 20 is not complete, then as shown in steps 10, 11, and 12, it is determined whether the holding portion 20 is in a suitable holding state for retrieval based on the detection information from the holding state detection sensors 37, and if it is determined that it is not in a suitable holding state for retrieval, then the raising and lowering motor M1 is driven to wind out the wires 2 to execute a lowering correction process of lowering the holding portion 20 by a set lowering amount, and then the procedure returns to step 10. This set lowering amount is preferably set to an amount sufficient for the holding state detection sensors 37 to detect a suitable holding state, but it can also be set to another amount. During the period that the holding state detection sensors 37 do not detect a suitable holding state for retrieval, the above lowering correction process is repeated until a set number of correction times has been reached, and if it is still determined that the holding state detection sensors 37 do not detect a suitable holding state for retrieval even after the set number of corrections has been executed, then it is determined that there an abnormality has occurred, and the operation is stopped.

In step 11, if it is determined that the holding state detection sensors 37 are detecting a suitable holding state for retrieval, then as shown in steps 13 and 14, the holding motor M2 is driven to open the holding chucks 22 and thereby switch the holding portion 20 into the hold release state. Next, the raising and lowering motor M1 is driven to wind out the wires 2 to perform a hold correction process of lowering the holding portion by a set lowering amount, after which the procedure is returned to step 2.

As shown in FIG. 7, to perform the release operation, as shown in step 24 the raising and lowering motor M1 is driven to wind out the wires 2 and lowers the holding portion 20 from the article accommodation space 14, and when it is detected that the holding portion 20 has been lowered to the target lowering position based on the information detected by the raised/lowered amount detection sensor 30, the raising and lowering motor M1 is stopped to stop the lowering of the holding portion 20.

As shown in steps 22, 23, and 24, when lowering of the holding portion 20 has stopped, it is determined whether the excess lowering detection sensor 34 is detecting excess lowering of the holding portion 20. If it is determined that excess lowering is not detected and that the suitable lowered state detection sensor 35 detects a suitable lowered state, and moreover, if it is determined that the hold release confirmation detection sensor 36 is detecting that holding portion 20 is in a holding state that is suitable for hold release, then the holding motor M2 is driven to open the holding chucks 22 and switches the holding portion 20 to the hold release state. Next, in step 26, the raising and lowering motor M1 is driven to wind up the wires 2 and raises up the holding portion 20 until it is returned to the home position HP of the article accommodation space 14.

In step 22, if it is determined that the excess lowering detection sensor 34 detects excess lowering of the holding portion 20, then as shown in step 27, it is determined whether the position of the holding portion 20 has shifted with respect to the article station 9 based on the detection information of the center displacement sensor 31. If it is determined that position displacement has occurred, then it is determined that an abnormality has occurred and operation is stopped. If it determined that position displacement has not occurred, then as shown in steps 28 and 29, the raising and lowering motor M1 is driven to wind up the wires 2 to perform a raising correction process of raising the holding portion 20 by a set raising amount, and then the procedure is returned to step 22. This set raising amount is preferably set to an amount sufficient to cancel the detection of excess lowering by the excess lowering detection sensor 34, but another amount can also be selected. During the time that the excess lowering detection sensor 34 detects excess lowering, the above raising correction process is performed repeatedly until a set number of corrections has been performed, and if it is determined that the excess lowering detection sensor 34 still detects excess lowering even after the set number of corrections has been performed, then it is determined that an abnormality has occurred and operation is stopped.

In step 23, if is determined that the suitable lowered state detection sensor 35 is not detecting a suitable lowered state, then it is determined that an abnormality has occurred and operation is stopped.

In step 24, if it is determined that the hold release confirmation detection sensor 36 does not detect that the holding portion 20 is in a holding state that is suitable for hold release, then as shown in steps 30 and 31, the raising and lowering motor M1 is driven to wind out the wires 2 to perform a lowering correction process of lowering the holding portion 20 by a set lowering amount, and then the procedure returns to step 22. This set lowering amount is preferably set to an amount sufficient for the hold release confirmation detection sensor 36 to detect a holding state suitable for hold release, but other amounts can be selected. During the period that the hold release confirmation detection sensor 36 does not detect a holding state suitable for hold release, the above lowering correction process is repeated until a set number of correction times has been reached, and if it is determined that the hold release confirmation detection sensor 36 does not detect a holding state suitable for hold release even after the set number of corrections has been performed, then it is determined that an abnormality has occurred and operation is stopped.

Thus, the transporting apparatus, when it has been given a run command for retrieval, stops the traveling carriage 10 at the article transfer target position S corresponding to the article station 9 at which the task is to be performed, and operates as shown in FIG. 8.

That is, as shown in FIG. 8A, the suspension wires 2 are wound out to lower the holding portion 20 in a hold release state in which the pair of holding chucks 22 are open.

As shown in FIG. 8B, when the holding portion 20 has been lowered to the target lowering position for switching to the holding state, the operation of winding out the suspension wires 2 is stopped to stop lowering of the holding portion 20.

At this time, the detected member 39 abuts against the flange 7 of the container 3 that is loaded on the article station 9 and is raised up with respect to the holding portion frame body 21, and when the amount that it is raised is suitable, the suitable lowered state detection sensor 35 is in a detecting state and the excess lowering detection sensor 34 is in the non-detecting state, then, as shown in FIG. 8C, the pair of holding chucks 22 are closed due to actuation of the holding motor M2 to switch the holding portion 20 to the holding state.

At this time, when the holding chuck opening sensor 32 detects that both of the holding chucks 22 have completely switched to the closed state without interference from the flange 7, for example, then, as shown in FIG. 8D, the suspension wires 2 are drawn in so that the holding portion 20 holds the container 3 with the pair of holding chucks 22, retrieves it from the article station 9 and lifts it upward.

When the holding portion 20 has been lowered to the target lowering position, then if it has been lowered too far below the target lowering position as shown in FIG. 10A, the detected member 39 is significantly raised up with respect to the holding portion frame body 21 and causes the excess lowering detection sensor 34 to enter the detecting state. When this occurs, the suspension wires 2 are drawn in to raise the holding portion 20 up to the hold release state with the pair of holding chucks 22 still open, and the target lowering position of the holding portion 20 is corrected upward such that the detected member 39 is lowered and continues to be detected by the suitable lowered state detection sensor 35, the excess lowering detection sensor 34 is switched to the non-detecting state. When the excess lowering detection sensor 34 is switched to the non-detecting state, then the transporting apparatus operates as shown in FIG. 8C. If the excess lowering detection sensor 34 is not switched into the non-detecting state even though raising correction of the holding portion 20 has been performed, then raising correction of the holding portion 20 is performed again. If the excess lowering detection sensor 34 is not switched to the non-detecting state even after the number of times this correction is repeated has reached a set number of corrections, then the operation is stopped in this state.

Figure 11A:
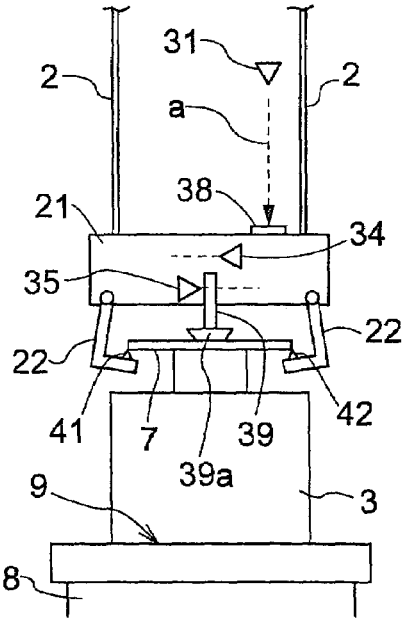
FIGS. 11A and B are explanatory diagrams showing lowering correction during the retrieval operation.

When the holding chucks 22 have been operated to close, if the holding chucks 22 catch on the container 3 and do not completely perform the closing operation as shown in FIG. 11A, then when the first holding chuck sensor 41 and the second holding chuck sensor 42 both sense pressure, the holding state detection sensors 37 detect that the container 3 is not held properly. When this occurs, the suspension wires 2 are wound out to lower the holding portion 20, correcting the target lowering position of the holding portion 20 downward such that it is switched to a suitable holding state in which both the first holding chuck sensor 41 and the second holding chuck sensor 42 do not sense pressure and the holding state detection sensors 37 detect that the container 3 is held suitably. When the holding state detection sensors 37 come to detect a suitable holding state, the apparatus operates as shown in FIG. 8C.

When the holding chucks 22 have been manipulated toward the closed posture, if even one of the first holding chuck sensor 41 and the second holding chuck sensor 42 detects pressure, then the holding state detection sensors 37 detect that the container 3 is not suitably held, and the holding portion 20 is lowered to correct the target lowering position of the holding portion 20 downward.

If the holding state detection sensors 37 do not switch to the state of detecting a holding state suitable for holding even after lowering correction of the holding portion 20 is performed, then lowering correction of the holding portion 20 is performed again. If the holding state detection sensor 37 does not come to detect a suitable holding state for holding even after the number of times that this process is repeated reaches a set number of corrections, operation is stopped in this state.

Figure 11B:
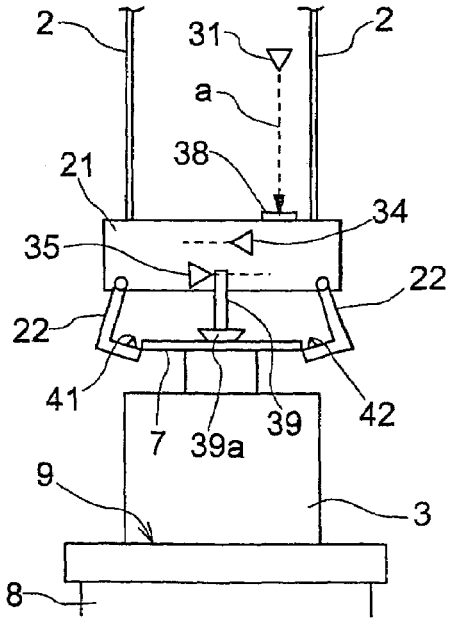

When the holding chucks 22 have been manipulated to the closed state, if the holding chucks 22 catch on the container 3 as shown in FIG. 11B and the closing operation of the holding chucks 22 is not completed even though neither the first holding chuck sensor 41 and the second holding sensor 42 sense pressure, then the holding chucks 22 are returned to the open state to return the holding portion 20 to the hold release state, after which the suspension wires 2 are lowered to lower the holding portion 20. Next, when switching the holding chucks 22 to the closed state, hold correction is performed such that the holding chucks 22 are completely switched to the closed state and the holding portion 20 is switched to a suitable holding state for suitably holding the container 3, and then the transporting apparatus operates as shown in FIG. 8C.

Also, the transporting apparatus, when it has been given a command for the release operation, stops the traveling carriage 10 at the article transfer target position S corresponding to the article station 9 at which the task is to be performed, and operates as shown in FIG. 9.

That is, as shown in FIG. 9A, the suspension wires 2 are wound out to lower the holding portion 20, which is holding the container 3 with the pair of holding chucks 22.

As shown in FIG. 9B, when the holding portion 20 has been lowered to the target lowering position for switching these to the hold release state, the operation of winding out the suspension wires 2 is stopped to stop lowering of the holding portion 20.

At this time, when the container 3 is loaded on the article station 9, the amount that the detected member 39 is raised up with respect to the holding portion frame body 21 after it has abutted against the flange 7 of the container 3 is suitable, the suitable lowered state detection sensor 35 is in the detecting state, the excess lowering detection sensor 34 is in the non-detecting state, and both the first holding chuck sensor 41 and the second holding chuck sensor 42 do not sense pressure and the hold release confirmation detection sensor 36 detects that the holding portion is in a suitable holding state for hold release, then as shown in FIG. 9C, the pair of holding chucks 22 are opened by the holding motor M2.

When the pair of holding chucks 22 are in the open state and the holding portion 20 is switched to the hold release state, then, as shown in FIG. 9D, the suspension wires 2 are drawn in so that the holding portion 20 is raised up, placing the container 3 on the article station 9.

Figure 12A:
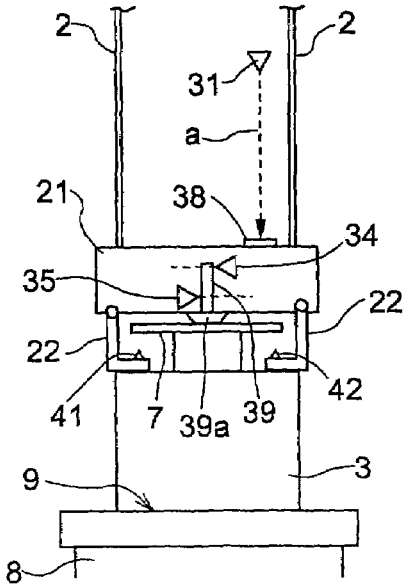
FIGS. 12A and B are explanatory diagrams showing raising correction during the release operation.
Figure 12B:
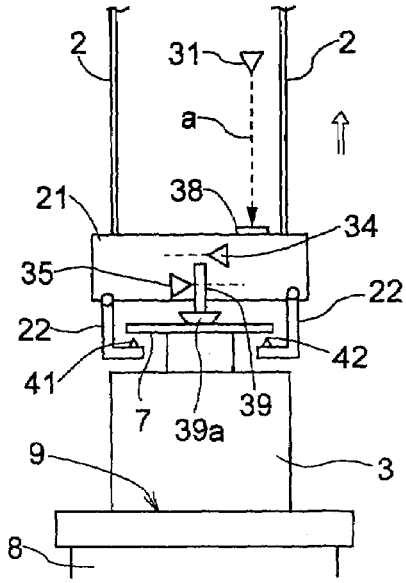

When the holding portion 20 has been lowered to the target lowering position, then if it has been lowered too far below the target lowering position as shown in FIG. 12A, the detected member 39 is raised up significantly with respect to the holding portion frame body 21 and the excess lowering detection sensor 34 is put into the detecting state. When this occurs, then as shown in FIG. 12B, the suspension wires 2 are drawn in to raise the holding portion 20 still in the holding state in which the pair of holding chucks 22 are closed, correcting the target holding position of the holding portion 20 upward such that the detected member 39 is lowered and continues to be detected by the excess lowering detection sensor 34 and the excess lowering detection sensor 34 is switched to the non-detecting state. When the excess lowering detection sensor 34 has been switched to the non-detecting state, the apparatus operates as shown in FIG. 9C. If the excess lowering detection sensor 34 is not switched to the non-detecting state even though raising correction of the holding portion 20 has been performed, then the raising correction operation of the holding portion 20 is performed again. If the excess lowering detection sensor 34 is not switched to the non-detecting state even after the number of times this procedure has been repeated reaches a set correction number, then the operation is stopped in this state.

Figure 13A:
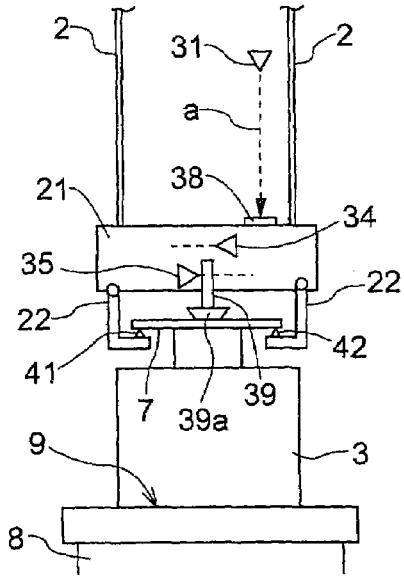
FIGS. 13A and B are explanatory diagrams showing lowering correction during the release operation.
Figure 13B:
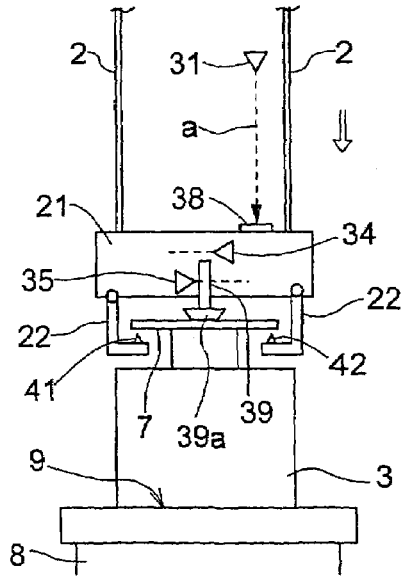

As shown in FIG. 13A, when the holding portion 20 has been lowered to the target lowering position, if the suitable lowered state detection sensor 35 is in the detecting state and the excess lowering detection sensor 34 is in the non-detecting state, the holding chuck sensors 41 and 42 sense pressure, and the hold release confirmation detection sensor 36 detects that the holding portion 20 is not in a holding state that is suitable for hold release, then as shown in FIG. 13B, the suspension wires 2 are drawn out to lower the holding portion 20, correcting the target lowering position of the holding portion 20 downward such that the holding portion 20 is switched to a state where neither the first holding chuck sensor 41 or the second holding chuck sensor 42 sense pressure and the hold release confirmation detection sensor 36 detects a suitable holding state for hold release. Once the hold release confirmation detection sensor 36 comes to detect a suitable holding state for hold release, the transporting apparatus operates as shown in FIG. 9C. If the hold release confirmation detection sensor 36 is not switched to a state where it detects a suitable holding state for hold release even though the lowering correction of the holding portion 20 has been performed, then lowering correction of the holding portion 20 is repeated. If the hold release confirmation detection sensor 36 is not in a state where it detects a suitable holding state for hold release even though the number of times this correction has been repeated reaches a set correction number, then the operation is stopped in this state.

As shown in FIG. 3, when the container 3 is accommodated in the article accommodation space 14*a* and transported, a catch member 45 provided in a lower portion of the accommodation frame 13 in such a manner that it can be manipulated between an open and a closed state is extended to a position below the container 3 to keep the container from falling. When retrieving or releasing the container 3, the catch member 45 is moved to a position where it is retreated from the position below the container 3.

OTHER WORKING EXAMPLES

The invention may be worked adopting various types of suspension members, such as belts and chains, in place of the suspension wires 2.

In addition to transporting apparatuses designed to carry semiconductor substrates 5 stored in the container 3, the present invention can also be adopted for transporting apparatuses designed to carry various types of articles other than semiconductor substrates 5, and transporting apparatuses designed to carry articles held directly with the holding portion without putting the articles into a container. Thus, the container 3 and the article are referred to generically as an article 3.

What is claimed is:

1. A transporting apparatus comprising:

a traveling carriage;

a holding portion for holding an article, the holding portion being capable of switching between a holding state and a hold release state and being supported to the traveling carriage so as to be raised and lowered with respect to the traveling carriage by a raising and lowering motor;

a raised/lowered amount detection sensor for detecting an amount that the holding portion has been raised or lowered by the raising and lowering motor;

an excess lowering detection sensor for detecting an excess lowering state where the holding portion has been lowered too far below a target lowering position that is an appropriate position for holding the article by detecting a relative vertical positional relationship between the holding portion and the article placed on an article station, and that is to be held by the holding portion;

a controller linked by signals to the raised/lowered amount detection sensor and the excess lowering detection sensor, wherein the controller controls operation of the raising and lowering motor and switching of the holding portion, with the traveling carriage stopped at a target position for article transfer, so as to raise and lower the holding portion and to retrieve an article loaded on an article station and release an article to the article station, and operates the raising and lowering motor to lowering to the target lowering position based on detection information from the raised/lowered amount detection sensor; and a detected member extending downwardly beyond a lower surface of the holding portion to contact the article to be held by the holding portion, wherein the excess lowering detection sensor is adapted to detect the detected member;

wherein when the holding portion is lowered to the target lowering position, the controller performs a raising correction process of raising the holding portion by a set raising amount if the excess lowered state has been detected by the excess lowering detection sensor, and wherein the controller repeatedly executes the raising correction process as long as the excess lowering detection sensor detects the excess lowering state unless a set number of corrections has been reached, and when the excess lowering state continues to be detected by the excess lowering detection sensor even after that set number of corrections has been performed, the controller determines that an abnormality has occurred.

2. The transporting apparatus according to claim 1, wherein the holding portion has at least a pair of chucks adapted to hold a flange spaced apart from an upper surface of the article to be held and having a smaller dimension in a fore-and-aft direction than the fore-and-aft dimension of the article and a smaller dimension in a lateral direction, that is perpendicular to the fore-and-aft direction, than the lateral dimension of the article, and wherein the at least a pair of chucks are located on the holding portion at positions such that the chucks are capable of moving in a space between the upper surface of the article and a lower surface of the flange.

3. The transporting apparatus according to claim 1, wherein the detected member has a first portion that is adapted to abut against the article to be held by the holding portion and a second portion that is sensed by the excess lowering detection sensor; and wherein the detected member has a first position in which the first portion is not in contact with the article to be held by the holding portion, a second position in which the first portion is in contact with the article to held by the holding portion with the holding portion in the appropriate position to hold the article, and a third position in which the first portion is in contact with the article to be held by the holding portion with the holding portion lowered beyond the appropriate position to hold the article.

4. A transporting apparatus comprising:

a traveling carriage:

a holding portion for holding an article, the holding portion being capable of switching between a holding state and a hold release state and being supported to the traveling carriage so as to be raised and lowered with respect to the traveling carriage by a raising and lowering motor;

a raised/lowered amount detection sensor for detecting an amount that the holding portion has been raised or lowered by the raising and lowering motor;

an excess lowering detection sensor for detecting an excess lowering state where the holding portion has been lowered too far below a target lowering position that is an appropriate position for holding the article by detecting a relative vertical positional relationship between the holding portion and the article placed on an article station, and that is to be held by the holding portion;

a controller linked by signals to the raised/lowered amount detection sensor and the excess lowering detection sensor, wherein the controller controls operation of the raising and lowering motor and switching of the holding portion, with the traveling carriage stopped at a target position for article transfer, so as to raise and lower the holding portion and to retrieve an article loaded on an article station and release an article to the article station, and operates the raising and lowering motor to lowering to the target lowering position based on detection information from the raised/lowered amount detection sensor;

a suitable lowered state detection sensor for detecting that the holding portion is in a suitable lowered state where the holding portion is positioned at or within a suitable range near the target lowering position by detecting the relative vertical positional relationship between the holding portion lowered to the target lowering position and an article loaded on the article station; and a hold release confirmation detection sensor for detecting whether a holding state in which the holding portion is holding an article loaded on the article station is a suitable holding state for switching the holding portion to a hold release state;

wherein when the holding portion is lowered to the target lowering position, the controller performs a raising correction process of raising the holding portion by a set raising amount if the excess lowered state has been detected by the excess lowering detection sensor, wherein the controller determines that an abnormality has occurred when in the retrieval operation and the release operation the excess lowering detection sensor does not detect an excess lowering state and the suitable lowered state detection sensor does not detect a suitable lowered state, and wherein the controller performs a lowering correction process for release in which the holding portion is lowered by a set lowering amount when, in the release operation, the excess lowering detection sensor does not detect excess lowering and the suitable lowered state detection sensor detects a suitable lowered state, and the hold release confirmation detection sensor does not detect a suitable holding state for release.

5. The transporting apparatus according to claim 4, further comprising:

a detected member extending downwardly beyond a lower surface of the holding portion to contact the article to be held by the holding portion, wherein the excess lowering detection sensor is adapted to detect the detected member, and wherein the controller repeatedly executes the lowering correction process for release until a set number of corrections has been reached as long as the suitable holding state is not detected by the hold release confirmation detection sensor, and when a suitable holding state for release is not detected by the hold release confirmation detection sensor even after a set number of corrections has been performed, the controller determines that an abnormality has occurred.

6. The transporting apparatus according to claim 4, wherein the holding portion has at least a pair of chucks adapted to hold a flange spaced apart from an upper surface of the article to be held and having a smaller dimension in a fore-and-aft direction than the fore-and-aft dimension of the article and a smaller dimension in a lateral direction, that is perpendicular to the fore-and-aft direction, than the lateral dimension of the article, and wherein the at least a pair of chucks are located on the holding portion at positions such that the chucks are capable of moving in a space between the upper surface of the article and a lower surface of the flange.

7. A transporting apparatus comprising:

a traveling carriage:

a holding portion for holding an article, the holding portion being capable of switching between a holding state and a hold release state and being supported to the traveling carriage so as to be raised and lowered with respect to the traveling carriage by a raising and lowering motor;

a raised/lowered amount detection sensor for detecting an amount that the holding portion has been raised or lowered by the raising and lowering motor;

an excess lowering detection sensor for detecting an excess lowering state where the holding portion has been lowered too far below a target lowering position that is an appropriate position for holding the article by detecting a relative vertical positional relationship between the holding portion and the article placed on an article station, and that is to be held by the holding portion;

a controller linked by signals to the raised/lowered amount detection sensor and the excess lowering detection sensor, wherein the controller controls operation of the raising and lowering motor and switching of the holding portion, with the traveling carriage stopped at a target position for article transfer, so as to raise and lower the holding portion and to retrieve an article loaded on an article station and release an article to the article station, and operates the raising and lowering motor to lowering to the target lowering position based on detection information from the raised/lowered amount detection sensor;

a suitable lowered state detection sensor for detecting that the holding portion is in a suitable lowered state where the holding portion is positioned at or within a suitable range near the target lowering position by detecting the relative vertical positional relationship between the holding portion lowered to the target lowering position and an article loaded on the article station; and a holding state detection sensor for detecting whether, in the retrieval operation, a holding state, in which the holding portion is holding an article loaded on the article station, is a suitable holding state in which the article is suitably held;

wherein when the holding portion is lowered to the target lowering position, the controller performs a raising correction process of raising the holding portion by a set raising amount if the excess lowered state has been detected by the excess lowering detection sensor, wherein the controller determines that an abnormality has occurred when in the retrieval operation and the release operation the excess lowering detection sensor does not detect an excess lowering state and the suitable lowered state detection sensor does not detect a suitable lowered state, and wherein the controller, in the retrieval operation, switches the holding portion to a holding state when the excess lowering detection sensor does not detect excess lowering and the suitable lowered state detection sensor detects a suitable lowered state, and when, due to this switching, the holding state detection sensor does not detect a suitable holding state, the controller executes a lowering correction process for retrieval in which the holding portion is lowered by a set lowering amount.

8. The transporting apparatus according to claim 7, further comprising:

a detected member extending downwardly beyond a lower surface of the holding portion to contact the article to be held by the holding portion, wherein the excess lowering detection sensor is adapted to detect the detected member, and wherein the controller repeatedly executes the lowering correction process for retrieval until a set number of corrections has been reached as long as the holding state detection sensor does not detect a suitable holding state, and when the holding state detection sensor does not detect a suitable holding state even after a set number of corrections has been performed, the controller determines that an abnormality has occurred.

9. The transporting apparatus according to claim 7, wherein the holding portion has at least a pair of chucks adapted to hold a flange spaced apart from an upper surface of the article to be held and having a smaller dimension in a fore-and-aft direction than the fore-and-aft dimension of the article and a smaller dimension in a lateral direction, that is perpendicular to the fore-and-aft direction, than the lateral dimension of the article, and wherein the at least a pair of chucks are located on the holding portion at positions such that the chucks are capable of moving in a space between the upper surface of the article and a lower surface of the flange.

10. A transporting apparatus comprising:

a traveling carriage;

a holding portion for holding an article, the holding portion being capable of switching between a holding state and a hold release state, and being supported to the traveling carriage such that the holding portion can be raised and lowered with respect to the traveling carriage by a raising and lowering motor;

a first sensor operatively linked to the raising and lowering motor, for detecting an amount that the holding portion has been raised or lowered with respect to the traveling carriage;

a second sensor for detecting information relating to a relative position in the vertical direction between the holding portion and the article to be held by the holding portion and for outputting a first signal indicative of the fact that the holding portion is lowered beyond an appropriate position to hold the article to be held by the holding portion;

a controller that is signally connected to the first sensor and the second sensor, wherein the controller raises the holding portion by a set raising amount in response to the first signal from the second sensor detecting that the holding portion is below a target lowering position that is the appropriate position for holding the article; and a detected member movable with respect to the holding portion and having a first portion that abuts against the article to be held by the holding portion and a second portion that is sensed by the second sensor;

wherein the detected member has a first position in which the first portion is not in contact with the article to be held by the holding portion, a second position in which the first portion is in contact with the article to held by the holding portion with the holding portion in the appropriate position to hold the article, and a third position in which the first portion is in contact with the article to be held by the holding portion with the holding portion lowered beyond the appropriate position to hold the article, and wherein the second sensor outputs the first signal in response to a sensing of the second portion of the detected member.

11. The transporting apparatus according to claim 10, further comprising:

a third sensor disposed at a position lower than the second sensor, wherein the third sensor outputs a second signal indicative of the fact that the holding portion is in the appropriate position for holding the article by sensing the second portion of the detected member.

12. The transporting apparatus according to claim 10, further comprising:

a pair of chucks that are provided in the holding portion and that are for holding the article, wherein each chuck is provided with a sensor that abuts against the article.

13. The transporting apparatus according to claim 10, wherein the holding portion has at least a pair of chucks adapted to hold a flange spaced apart from an upper surface of the article to be held and having a smaller dimension in a fore-and-aft direction than the fore-and-aft dimension of the article and a smaller dimension in a lateral direction, that is perpendicular to the fore-and-aft direction, than the lateral dimension of the article, and wherein the at least a pair of chucks are located on the holding portion at positions such that the chucks are capable of moving in a space between the upper surface of the article and a lower surface of the flange.

* * * * *

UNITED STATES PATENT AND TRADEMARK OFFICE

CERTIFICATE OF CORRECTION

PATENT NO. : 7,255,238 B2
APPLICATION NO. : 10/890713
DATED : August 14, 2007
INVENTOR(S) : Ikeya It is certified that error appears in the above-identified patent and that said Letters Patent is hereby corrected as shown below:

Column 14, Line 9, Claim 3, "to held" should read -- to be held --
(See the Amendment dated January 12, 2007, page 9, Line 1 of Claim 14.
Claim 14 issued as Claim 3.)

Column 17, Line 33, Claim 10, "to held" should read -- to be held --
(See the Amendment dated January 12, 2007, page 7, Line 21 of Claim 8.
Claim 8 issued as Claim 10.)

Signed and Sealed this

Twenty-fifth Day of December, 2007

JON W. DUDAS
*Director of the United States Patent and Trademark Office*